US012551810B2

(12) United States Patent
Li

(10) Patent No.: US 12,551,810 B2
(45) Date of Patent: Feb. 17, 2026

(54) MECHANICAL FIDGET TOY AND ELECTRONIC EQUIPMENT STAND

(71) Applicant: Shenzhen Jinbofeng Technology Co., Ltd., Shenzhen (CN)

(72) Inventor: Qunbo Nick Li, Shenzhen (CN)

(73) Assignee: Shenzhen Jinbofeng Technology Co., Ltd., Shenzhen (CN)

( * ) Notice: Subject to any disclaimer, the term of this patent is extended or adjusted under 35 U.S.C. 154(b) by 0 days.

(21) Appl. No.: 19/238,156

(22) Filed: Jun. 13, 2025

(65) Prior Publication Data

US 2025/0303314 A1 Oct. 2, 2025

(30) Foreign Application Priority Data

Jun. 14, 2024 (CN) ..... 202421361502.2
Feb. 12, 2025 (CN) ..... 202520222524.9

(51) Int. Cl.
*A63H 33/00* (2006.01)
*A63F 9/04* (2006.01)

(52) U.S. Cl.
CPC ..... *A63H 33/00* (2013.01); *A63F 9/04* (2013.01)

(58) Field of Classification Search
CPC .... A63F 5/0011; A63F 5/0017; A63F 5/0023; A63F 5/0041; A63F 5/04; A63F 5/043; A63F 5/045; A63F 5/048
USPC ..... 446/239, 243, 246, 266, 489; 273/141 R, 273/141 A, 142 R, 143 R, 143 C, 143 D, 273/142 J, 142 JA, 142 JB, 142 JC, 273/142 JD, 268
See application file for complete search history.

(56) References Cited

U.S. PATENT DOCUMENTS 121,110 A * 11/1871 Klienburg ..... A63F 5/048 273/142 H
474,188 A * 5/1892 Rabiger ..... A63F 5/048 273/142 H
2,208,351 A * 7/1940 Von Berg ..... A63F 5/0094 273/142 H
2,548,837 A * 4/1951 Wright ..... A63F 5/048 235/113
2,888,265 A * 5/1959 Wagner ..... A63F 5/048 446/213
3,046,018 A * 7/1962 Serpico ..... A63F 5/048 273/272
3,198,522 A * 8/1965 Parks ..... A63F 5/048 273/142 R (Continued)

*Primary Examiner* — Joseph B Baldori
(74) *Attorney, Agent, or Firm* — All West Law Group PLLC; Aaron Powell

(57) ABSTRACT

A mechanical fidget toy includes a housing, a pushing component and at least one rotating plate. One end of the pushing component is exposed outside the housing, and another end of the pushing component is provided with a resetting component. Each of the at least one rotating plate is movably connected to the housing. A plurality of display areas is arranged on the surface of each of the at least one rotating plate. Each of the plurality of display areas is provided with different signs. The housing is provided with a plurality of observation windows, and users can observe the signs on at least one rotating plate through the observation windows. The pushing component is used to push the at least one rotating plate to rotate or limit the rotation of the at least one rotating plate.

9 Claims, 4 Drawing Sheets

(56) References Cited

U.S. PATENT DOCUMENTS

| | | | | | |
|---|---|---|---|---|---|
| 3,243,185 | A * | 3/1966 | Miller | A63F 5/048 | 273/142 R |
| 3,733,076 | A * | 5/1973 | Ohki | G07C 15/00 | D19/64 |
| 4,437,665 | A * | 3/1984 | Coster | A63F 9/04 | 446/236 |
| 4,961,581 | A * | 10/1990 | Barnes | A63F 3/00 | 273/287 |
| 5,382,023 | A * | 1/1995 | Roberts | A63F 11/0011 | 273/142 H |
| 8,256,771 | B2 * | 9/2012 | Marquez | A63F 5/00 | 273/142 E |
| 12,324,982 | B2 * | 6/2025 | Kinsella | A63F 9/0819 | |
| 12,377,342 | B2 * | 8/2025 | Yarro | B43K 29/002 | |

* cited by examiner

MECHANICAL FIDGET TOY AND ELECTRONIC EQUIPMENT STAND

CROSS-REFERENCE TO RELATED APPLICATIONS

The present application claims the benefits of Chinese Patent Application No. 2024213615022 filed on Jun. 14, 2024, and Chinese Patent Application No. 2025202225249 filed on Feb. 12, 2025. The contents of which are hereby incorporated by reference.

TECHNICAL FIELD

The invention belongs to the technical field of entertainment products and particularly relates to a mechanical fidget toy:

TECHNICAL BACKGROUND

The dice device is a small prop for table games. The most common dice is the six-sided dice, which is a regular cube with one to six holes on it. When the user throws the dice, and the number on the side facing up is the number of points thrown. This way of throwing dice is too common and cannot attract people to use it. And the function of this dice is relatively single.

INVENTION CONTENT

In order to overcome the defects of the prior art, the present invention provides a mechanical fidget toy and electronic equipment stand. People can play the mechanical fidget toy in different ways, from which people receive much fun and pleasure. The market competitiveness of the mechanical fidget toy increases and attracts more people to purchase. The stand can be used to support the electronic equipment, and can also hold the mechanical fidget toy, making it convenient for users to carry.

The technical scheme adopted by the present invention for solving the technical problems is as follows:

A mechanical fidget toy includes a housing, a pushing component and at least one rotating plate. One end of the pushing component is exposed outside the housing, and the other end of the pushing component is provided with a resetting component. Each of the at least one rotating plate is movably connected to the housing. A plurality of display areas is arranged on the surface of each of the at least one rotating plate. Each of the at least one display area is provided with different signs. The housing is provided with a plurality of observation windows, and users can observe the signs on at least one rotating plate through the observation windows. The pushing component is used to push the at least one rotating plate to rotate or limit the rotation of the at least one rotating plate.

Further, the pushing component includes a pushing plate. A fastener piece is arranged inside the housing. A bar-type hole extending in the longitudinal direction is arranged on the pushing plate. The fastener piece is inserted into the bar-type hole and fixedly connected to the housing.

Further, the housing includes a bottom casing and a top cover. The bottom casing is provided with a plurality of connection slots. The top cover is provided with a plurality of connection columns. The plurality of connection slots corresponds to the plurality of connection columns one by one.

Further, a plurality of inserting columns is arranged in the bottom casing. A plurality of inserting holes is arranged on at least one rotating plate. Each inserting column respectively passes through each inserting hole. At least one rotating plate can rotate relative to the bottom casing.

Further, the pushing component includes a pushing plate. The at least one rotating plate includes a first rotating plate and a plurality of second rotating plates. The first rotating plate is located in the middle part of the housing, and the plurality of second rotating plates are located on the two sides of the first rotating plate and distributed up and down.

Further, a plurality of ratchets are arranged on the side of the at least one rotating plate facing away from the display area. The pushing component is provided with a plurality of movable components and a plurality of limited sections. The plurality of movable components extends to the edge of the plurality of ratchets. The housing is also provided with a retraction component, which can make the plurality of movable components move in the direction away from the plurality of ratchets or move in the direction close to the plurality of ratchets. The plurality of limited sections, spaced apart from the plurality of movable components is located below the plurality of movable components.

Further, each of the plurality of movable components can switch between a first position and a second position under an external force; each of the plurality of retraction components is arranged between the first position and the second position. Each of the first position and each of the second position are respectively provided with one first magnet and one second magnet; each of the first magnet and each of the second magnet are embedded in an inner wall of the housing; each of the plurality of movable components is embedded with one third magnet; A third magnet is respectively embedded in each of the plurality of movable components. The third magnet has the opposite magnetic pole to the first magnet, while share the same magnetic pole with the second magnet. Each of the first magnet at each of the first position is located at a side close to each of the plurality of rotating plates respectively, while each of the first magnet at the second position is located at a side away from each of the plurality of rotating plates respectively.

Further, the pushing component includes a pushing plate, which is provided with a second mounting groove. The plurality of movable components is arranged in the second mounting groove. One end of each of the plurality of movable components extends out of the pushing plate.

Further, the pushing component includes a pushing plate. The resetting component includes a convex piece and a resetting spring. The convex piece is arranged at the bottom end of the pushing plate. One end of the resetting spring is sleeved on the outer periphery of the convex piece, and the other end of the resetting spring is overlapped on the bottom end of the housing.

Further, the convex piece, the limited section and the pushing plate are integrally formed.

After adopting the above technical scheme, the present invention has the following beneficial effects.

First, the mechanical fidget toy has strong entertainment and interest. There are six display areas, each display area is provided with different dice patterns. The pushing component cooperates with the rotating plate to make the display areas randomly present different dice patterns. Users can observe the different dice patterns through the observation windows, thereby enhancing entertainment and interest.

Second, the mechanical fidget toy can be customized. The number of rotating plates can be customized according to the actual needs of users, and the display areas can be provided with rock-paper-scissors patterns or other specified patterns according to the users' needs.

Third, the mechanical fidget toy has a stable structure. The bottom casing and the top cover are matched through the connection slots and the connection columns. The connection is firm after pouring glue and buckling. The inserting columns cooperate with the inserting holes on the rotating plate. The rotating plate is provided with the bearing, which cooperates with the bottom casing and the top cover to restrict the rotating plate inside the housing. Therefore, the structure of the mechanical fidget toy and electronic equipment stand is stable.

Fourth, the mechanical fidget toy has a limiting effect. The fastener piece arranged inside the housing is inserted into the bar-type hole on the pushing plate and fixedly connected to the housing, limiting the moving direction of the pushing plate so that the pushing plate can only slide in a vertical direction along the bar-type hole.

Fifth, the mechanical fidget toy has a stress-relieving effect. When the user presses and releases the pushing component, the movable component or the limited section collides with the ratchet to produce a sound, which has a stress-relieving effect.

DESCRIPTION OF MARKS IN FIGURES

1—housing: 11—bottom casing: 111—connection slot: 112—inserting column; 1121—first inserting column: 1122—second inserting column: 113—first mounting groove: 12—top cover; 121—connection column: 122—observation window; 13—fastener piece:

2—pushing component: 21—pushing plate: 22—second mounting groove: 23—bar-type hole: 24—mounting hole: 25—movable component: 251—third magnet: 26—limited section;

3—rotating plate: 31—inserting hole: 32—first rotating plate: 33—second rotating plate: 34—ratchet: 35—display area: 36—bearing:

4—resetting component: 41—convex piece: 42—resetting spring:

5—retraction component: 51—first magnet: 52—second magnet:

DETAILED DESCRIPTION OF THE EMBODIMENTS

The present embodiment only shows an explanation of the present invention, and it is not a limitation to the present invention. The skilled in the art can make modifications to this embodiment as needed without making any creative contributions after reading this specification, which are always protected by the patent law as long as they are within the scope of the claims of the present invention.

Embodiment I

Figure 1:
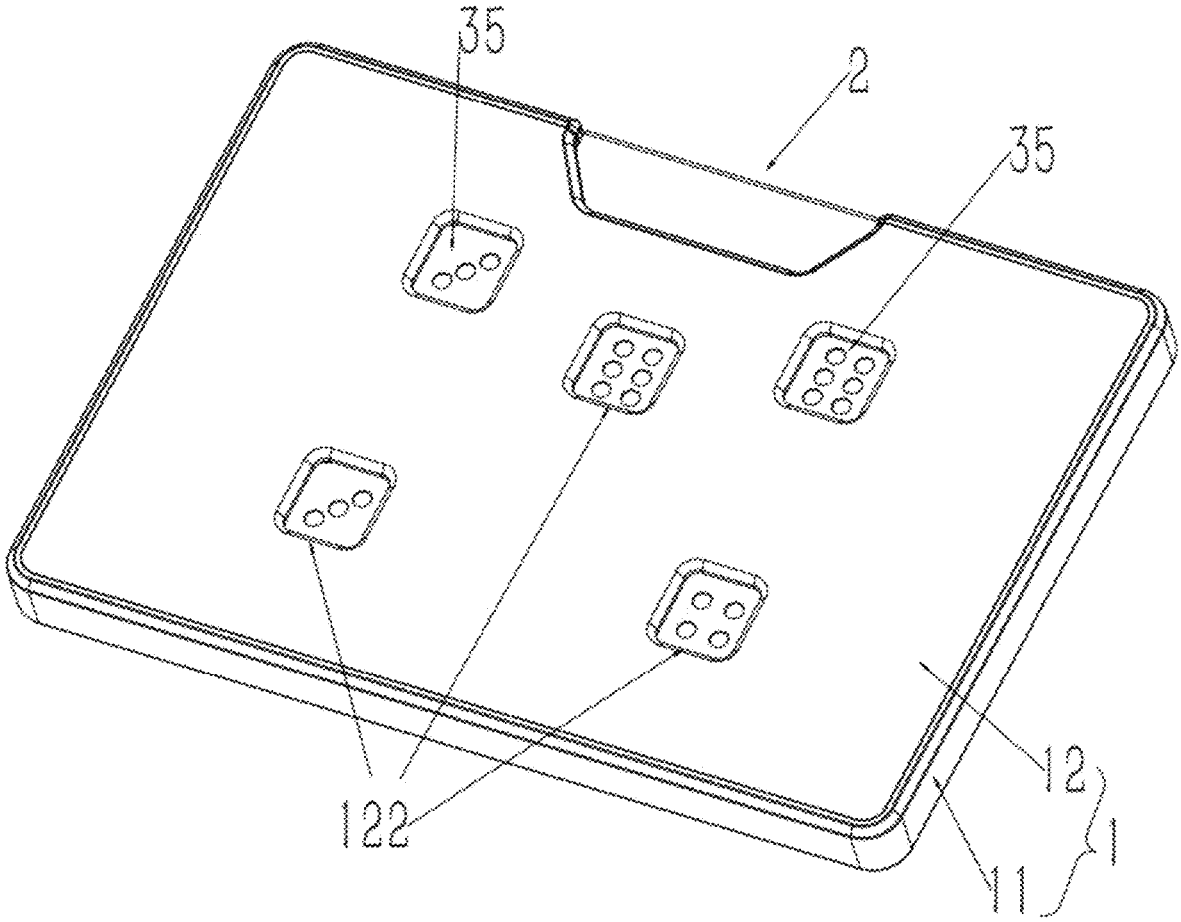
FIG. 1 is a schematic view of a mechanical fidget toy of the present invention.
Figure 2:
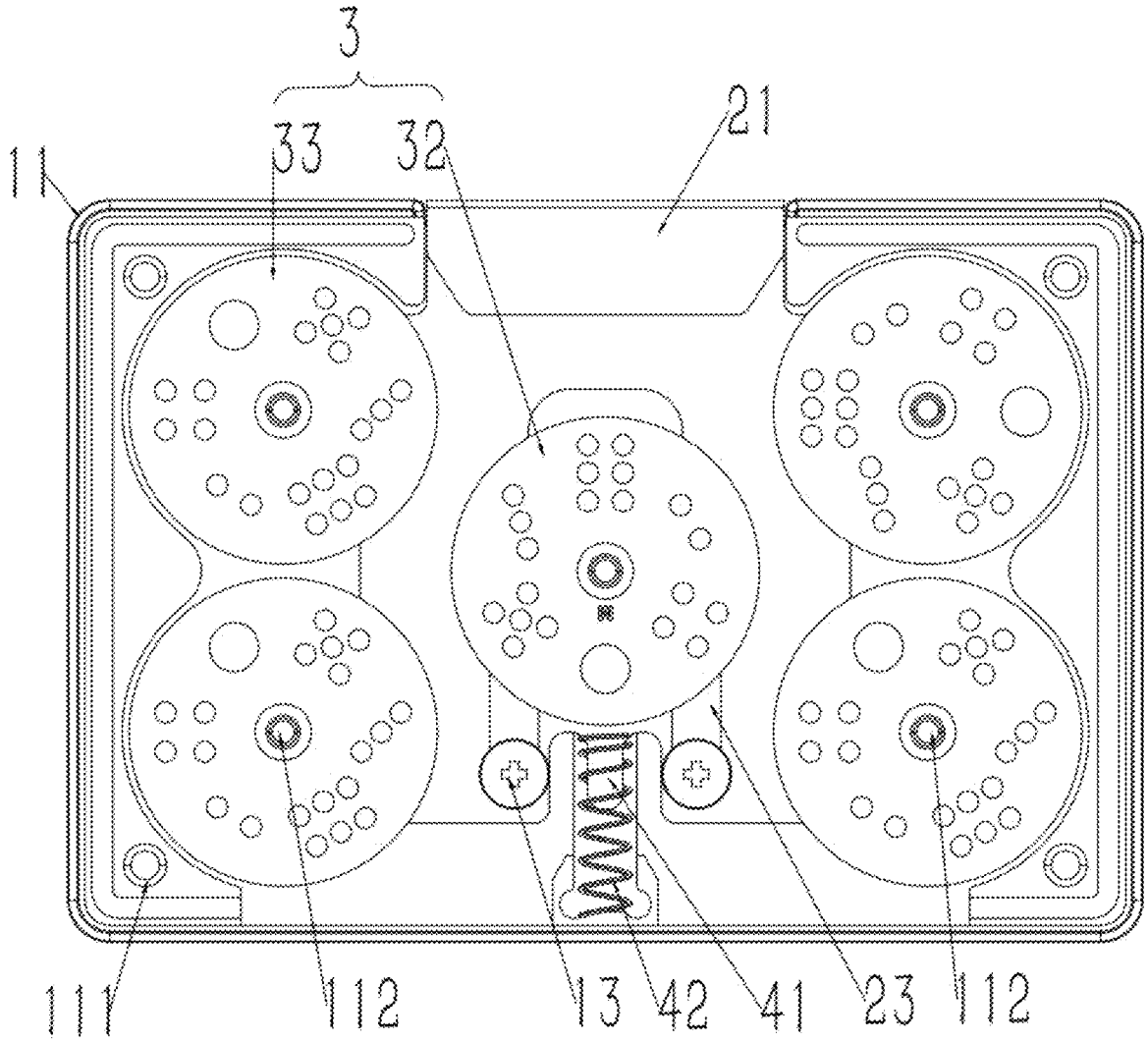
FIG. 2 is a schematic view of the mechanical fidget toy of the present invention after the top cover is removed.
Figure 3:
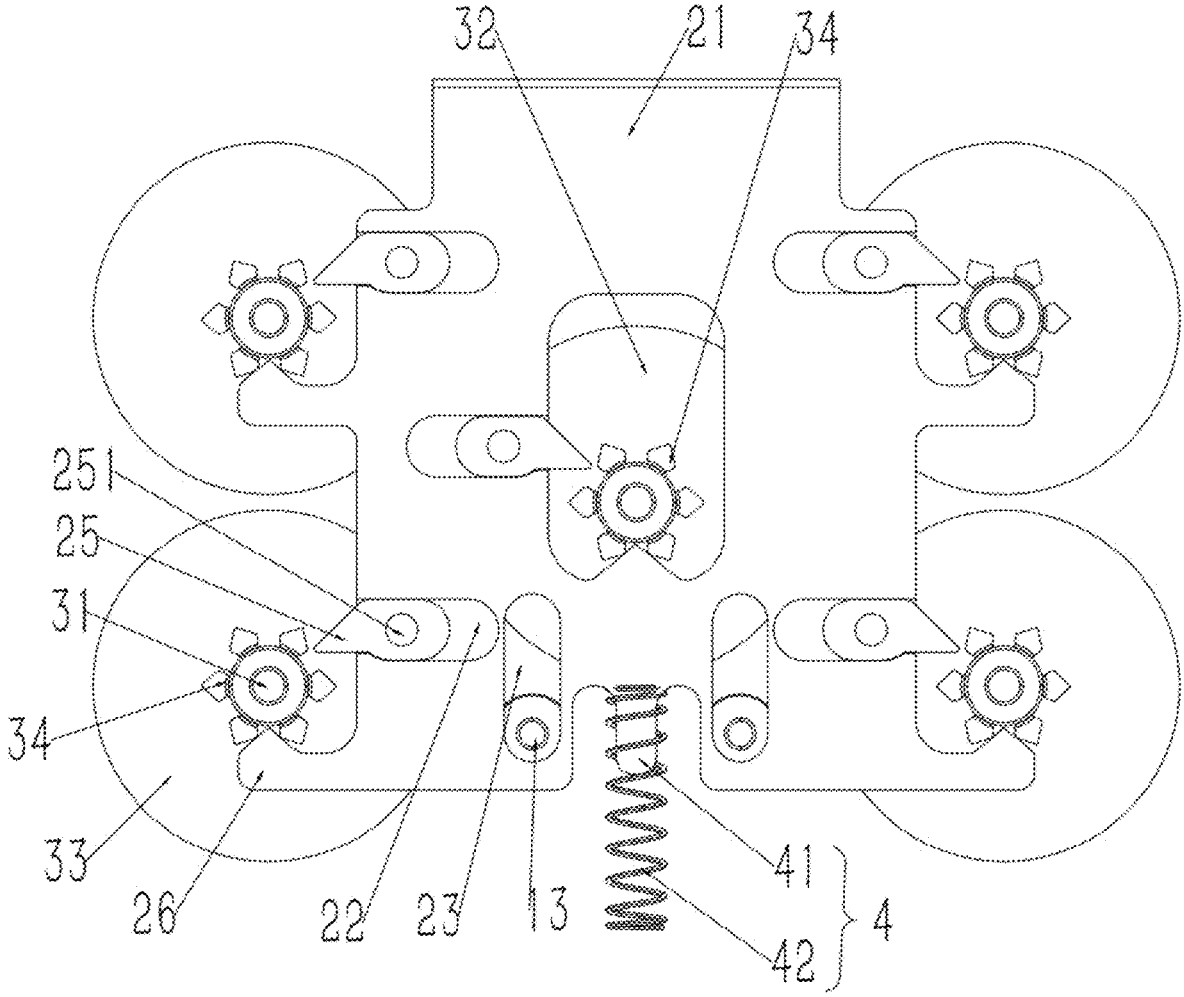
FIG. 3 is a schematic view of the cooperation of the pushing component and the rotating plate of the present invention.
Figure 4:
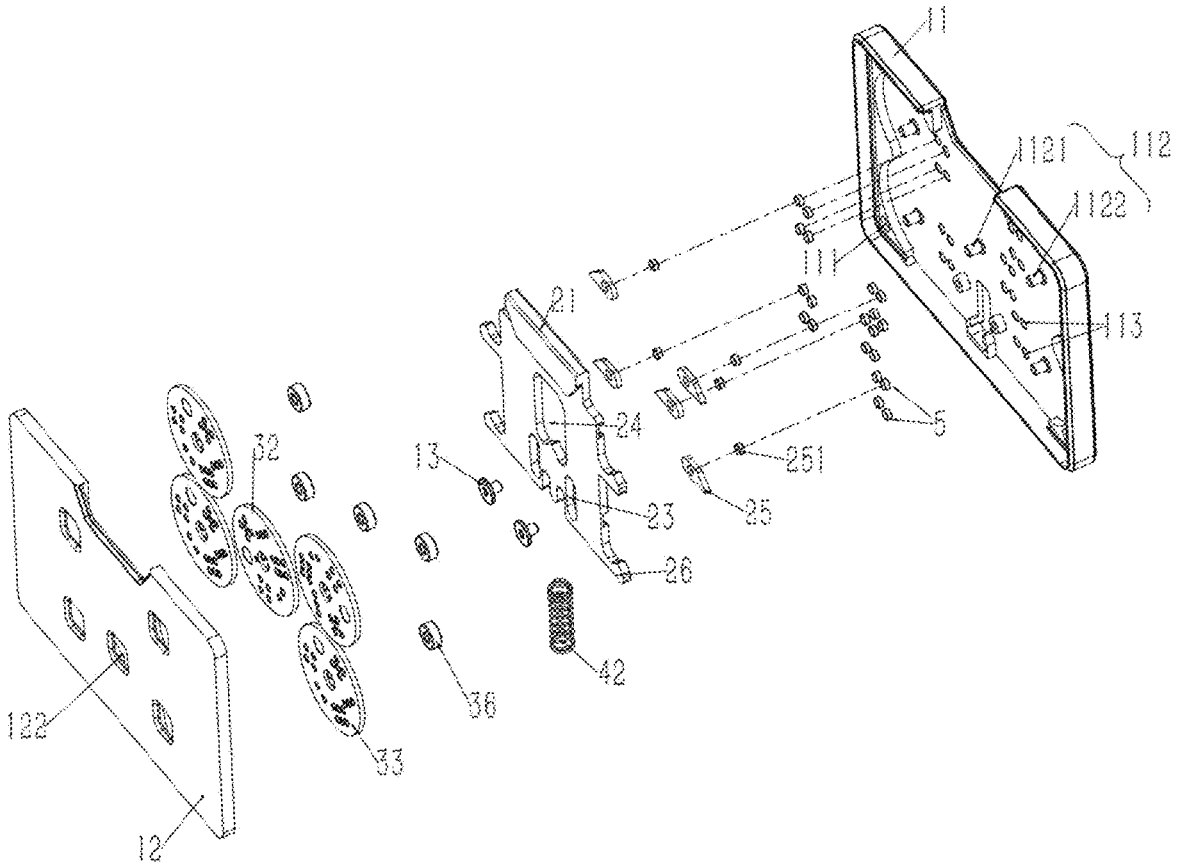
FIG. 4 is an exploded view of the mechanical fidget toy of the present invention.
Figure 5:
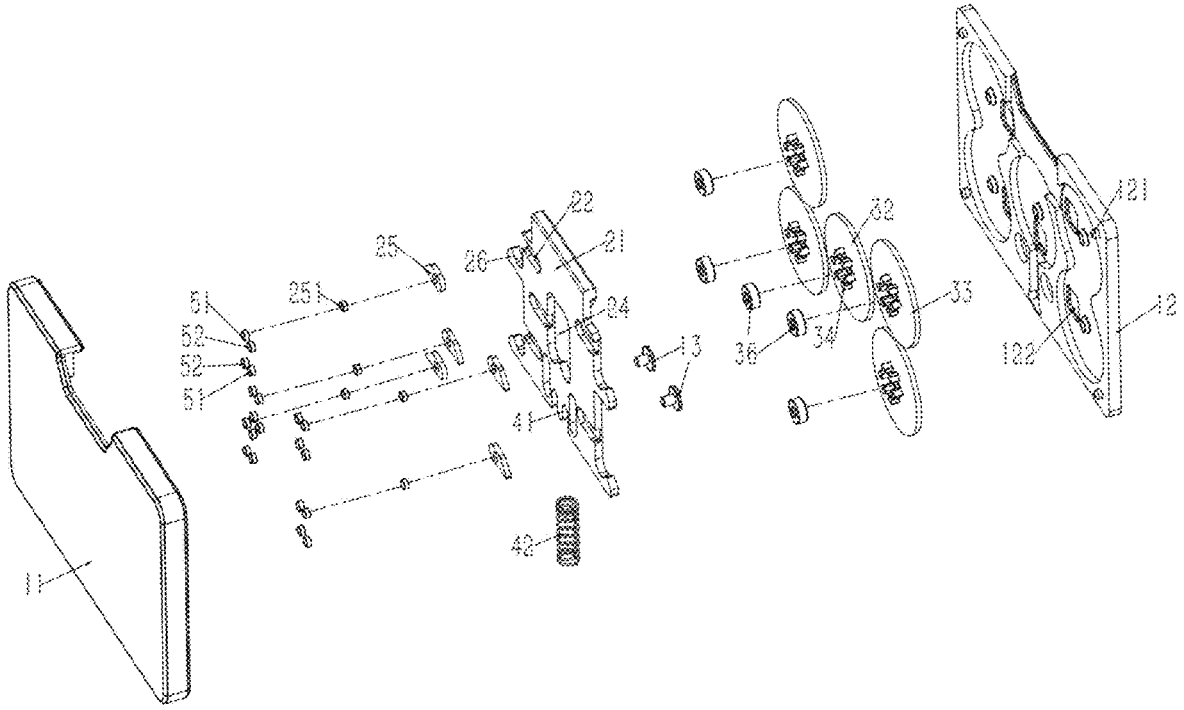
FIG. 5 is an exploded view of the mechanical fidget toy of the present invention from another angle.

Referring to FIG. 1 to FIG. 5, the present embodiment provides a mechanical fidget toy, including a housing 1, a pushing component 2 and at least one rotating plate 3. One end of the pushing component 2 is exposed outside the housing 1, and the other end of the pushing component 2 is provided with a resetting component 4. Each of at least one rotating plate 3 is movably connected to the housing 1. A plurality of display areas 35 are arranged on the surface of each of at least one rotating plate 3. Each display area 35 is provided with different signs. The housing 1 is provided with a plurality of observation windows 122, and users can observe the signs on at least one rotating plate 3 through observation windows 122. The pushing component 2 is used to push the at least one rotating plate 3 to rotate or limit the rotation of the at least one rotating plate 3.

Preferably, five rotating plates 3 are provided. In actual applications, the number of rotating plates 3 can be one, or any number above one. The specifications of the rotating plates 3 can be customized according to actual needs of users.

Preferably, a fastener piece 13 is arranged inside the housing 1. A bar-type hole 23 extending in the longitudinal direction is arranged on pushing plate 21. The fastener piece 13 is inserted into the bar-type hole 23 and fixedly connected to the housing 1. The fastener piece 13 cooperates with the bar-type hole 23 to limit the moving direction of the pushing plate 21, so that pushing plate 21 can only slide in the vertical direction along the bar-type hole 23.

Preferably, the housing 1 includes a bottom casing 11 and a top cover 12. The bottom casing 11 is provided with a plurality of connection slots 111, and the top cover 12 is provided with a plurality of connection columns 121. The plurality of connection slots 111 correspond to the plurality of connection columns 121 one by one.

When connecting the bottom casing 11 with the top cover 12, pour a certain amount of glue into the connection slot 111, insert the corresponding connection column 121 into the corresponding connection slot 111, buckle the bottom casing 11 and the top cover 12, and wait for a while for the glue to dry, so that the bottom casing 11 can be firmly connected with the top cover 12.

In this embodiment, the signs on at least one rotating plate 3 is the are dice numbers, and the user can observe the dice patterns on one of the display areas 35 through observation windows 122.

Further, a plurality of inserting columns 112 are arranged in the bottom casing 11. A plurality of inserting holes 31 are arranged on at least one rotating plate 3. Each inserting column 112 respectively passes through each inserting hole 31. At least one rotating plate 3 can rotate relative to the bottom casing 11.

Preferably, at least one rotating plate 3 includes a first rotating plate 32 and a plurality of second rotating plates 33. The first rotating plate 32 is located in the middle part of the housing 1. The plurality of second rotating plates 33 are located on two sides of the first rotating plate 32 and distributed up and down.

Specifically, a plurality of mounting holes 24 are arranged in the middle part of the pushing plate 21. A plurality of bearings 36 are arranged at the inserting holes 31 of the first rotating plate 32 and the second rotating plates 33. The inserting columns 112 includes first inserting column 1121 and a second inserting column 1122. The first inserting column 1121 passes through the mounting hole 24, the bearing 36 and the inserting hole 31 of the first rotating plate 32 in sequence: the second inserting column 1122 passes through the bearing 36 and the inserting hole 31 of the second rotating plate 33. Finally, the first rotating plate 32 and the second rotating plate 33 are restricted inside the housing 1 through the connection and cooperation of the bottom casing 11 and the top cover 12.

Preferably, a plurality of ratchets 34 is arranged on the side of the at least one rotating plate 3 facing away from the display area 35. The pushing component 2 is provided with a plurality of movable components 25 and a plurality of limited sections 26. The plurality of movable components 25 extends to the edge of the plurality of ratchets 34. The housing 1 is also provided with a at least one retraction component 5, which can make the movable component 25 move in a direction away from the plurality of ratchets 34 or in a direction close to the plurality of ratchets 34. The plurality of limited sections 26 spaced apart from the plurality of movable components 25 are located below the plurality of movable components 25.

When a downward external force is applied to the pushing component 2, the plurality of movable components 25 will toggle the plurality of ratchets 34 and thereby drive the at least one rotating plate 3 to rotate. At the same time, the plurality of movable components 25 will move under the action of at least one retraction component 5 and will not affect the rotation of the rotating plate 3. When the external force applied to the pushing component 2 is canceled, the plurality of limited sections 26 can cooperate with the plurality of ratchets 34 to limit the rotation of the at least one rotating plate 3 under the action of the resetting component 4.

In this embodiment, six display areas 35 are provided. Each display area 35 is provided with different dice patterns. Through the cooperation of the pushing component 2 and the at least one rotating plate 3, the display areas 35 exposed on the housing 1 can randomly present different dice patterns, thereby improving entertainment and fun. When the user presses and releases the pushing component 2, the plurality of movable components 25 or the plurality of limited sections 26 can collide with the plurality of ratchets 34 to produce a sound, and the at least one rotating plate 3 can also make a sound when it rotates, thereby achieving a stress-relieving effect.

In actual applications, a rock-paper-scissors pattern or other designated patterns may be set in the display areas 35 according to the user's needs.

Further, each of the plurality of movable components 25 can switch between a first position and a second position under an external force; each of the plurality of retraction components 5 is arranged between the first position and the second position. Each of the first position and each of the second position are respectively provided with one first magnet 51 and one second magnet 52; each of the first magnet 51 and each of the second magnet 52 are embedded in an inner wall of the housing 1; each of the plurality of movable components 25 is embedded with one third magnet 251; The first magnet 51 and the second magnet 52 are embedded in the inner wall of the housing 1. The third magnet 251 has the opposite magnetic pole to the first magnet 51, while share the same magnetic pole with the third magnet 251. Each of the first magnet 51 at each of the first position is located at a side close to each of the plurality of rotating plates 3 respectively, while each of the first magnet 51 at the second position is located at a side away from each of the plurality of rotating plates 3 respectively.

Specifically, a first mounting groove 113 for mounting the first magnet 51 and the second magnet 52 is arranged on the bottom casing 11.

When no external force is applied to pushing component 2, the plurality of movable components 25 are located at the first position, and the at least one third magnet 251 is attracted to the first magnet 51. When an external force is applied to the pushing component 2 to move the plurality of movable components 25 downward to the second position, the third magnet 251 of each of the plurality of movable components 25 will repel the second magnet 52 and move in a direction away from the at least one rotating plate 3 until the third magnet 251 is attracted to the first magnet 51. The plurality of movable components 25 will no longer collide with the plurality of ratchets 34, thereby avoiding affecting the rotation of the plurality of ratchets t 34.

Preferably, pushing component 2 includes a pushing plate 21, which is provided with a second mounting groove 22. Movable component 25 is arranged in the second mounting groove 22, and one end of each of the plurality of movable components 25 extends out of the pushing plate 21.

Further, the resetting component 4 includes a convex piece 41 and a resetting spring 42. The convex piece 41 is arranged at the bottom end of the pushing plate 21. One end of the resetting spring 42 is sleeved on the outer periphery of the convex piece 41, and the other end of the resetting spring 42 is overlapped on the bottom end of the housing 1.

Further, the convex piece 41, the plurality of limited sections 26 and the pushing plate 21 are integrally formed.

It could be understood that under the guidance of the above embodiments, those skilled in the filed can combine various implementation methods in the above embodiments to obtain technical solutions of multiple implementation methods.

The above description is only a preferred embodiment of the present invention and is not to limit the present invention. Any modifications, equivalent substitutions and improvements made within the spirit and principles of the present invention should be included in the protection scope of the present invention.

The invention claimed is:

1. A mechanical fidget toy comprises a housing, a pushing component and a plurality of rotating plates, wherein one end of the pushing component is exposed outside the housing, and another end of the pushing component is provided with a resetting component; each of the plurality of rotating plates is movably connected to the housing; a plurality of display areas are arranged on a surface of each of the plurality of rotating plates; each of the plurality of display areas is provided with different signs; the housing is provided with a plurality of observation windows, users can observe the signs on the plurality of rotating plates through the plurality of observation windows; the pushing component is used to push the plurality of rotating plates to rotate or limit the rotation of the plurality of rotating plates; a plurality of ratchets are arranged on a side of each of the plurality of rotating plates facing away from the display area; the pushing component is provided with a plurality of movable components and a plurality of limited sections; the plurality of movable components extend to an edge of each of the plurality of ratchets; the housing is further provided with a plurality of retraction components which can make the plurality of movable components move in a direction away from the plurality of ratchets or in a direction close to the plurality of ratchets; each of the plurality of movable components can switch between a first position and a second position under an external force; each of the plurality of retraction components is arranged between the first position and the second position; each of the first position and each of the second position are respectively provided with one first magnet and one second magnet; each of the first magnets and each of the second magnets are embedded in an inner wall of the housing; each of the plurality of movable components is embedded with one third magnet; each of the third magnets has an opposite magnetic pole to each of the first magnets, while sharing a same magnetic pole with each of the second magnets; each of the first magnets at each of the first positions is located at a side close to each of the plurality of rotating plates respectively, while each of the first magnets at the second positions are located at a side away from each of the plurality of rotating plates respectively.

2. The mechanical fidget toy according to claim 1, wherein the pushing component comprises a pushing plate; a fastener piece is arranged inside the housing; a bar-type hole extending in a longitudinal direction is arranged on the pushing plate; the fastener piece is inserted into the bar-type hole and fixedly connected to the housing.

3. The mechanical fidget toy according to claim 1, wherein the housing comprises a bottom casing and a top cover; the bottom casing is provided with a plurality of connection slots; the top cover is provided with a plurality of connection columns; the plurality of connection slots corresponds to the plurality of connection columns one by one.

4. The mechanical fidget toy according to claim 3, wherein a plurality of inserting columns are arranged in the bottom casing; a plurality of inserting holes are arranged on each of the at least one rotating plate; each of the plurality of inserting columns respectively passes through each of the plurality of inserting holes; the at least one rotating plate can rotate relative to the bottom casing.

5. The mechanical fidget toy according to claim 1, wherein the pushing component comprises a pushing plate; the plurality of rotating plates comprise a first rotating plate and a plurality of second rotating plates; the first rotating plate is located in a middle part of the housing; the plurality of second rotating plates are located on two sides of the first rotating plate and distributed up and down.

6. The mechanical fidget toy according to claim 1, wherein the plurality of limited sections spaced apart from the plurality of movable components are located below the plurality of movable components.

7. The mechanical fidget toy according to claim 1, wherein the pushing component comprises a pushing plate, which is provided with a second mounting groove; the movable component is arranged in the second mounting groove; one end of the movable component extends out of the pushing plate.

8. The mechanical fidget toy according to claim 1, wherein the pushing component comprises a pushing plate; the resetting component comprises a convex piece and a resetting spring; the convex piece is arranged at a bottom end of the pushing plate; one end of the resetting spring is sleeved on an outer periphery of the convex piece, and another end of the resetting spring is overlapped on a bottom end of the housing.

9. The mechanical fidget toy according to claim 8, wherein the convex piece, the plurality of limited sections and the pushing plate are integrally formed.

* * * * *